US008762010B2

(12) United States Patent
Farmer et al.

(10) Patent No.: US 8,762,010 B2
(45) **Date of Patent: *Jun. 24, 2014**

(54) IMPLEMENT CONTROL SYSTEM FOR A MACHINE

(71) Applicant: Caterpillar Inc., Peoria, IL (US)

(72) Inventors: Todd R. Farmer, Apex, NC (US); Charles W. Grant, Raleigh, NC (US); Gregory A. Epplin, Apex, NC (US); Michael J. Chadwick, Cary, NC (US); Joshua D. Callaway, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/839,253

(22) Filed: Mar. 15, 2013

(65) Prior Publication Data

US 2013/0317707 A1 Nov. 28, 2013

Related U.S. Application Data

(63) Continuation of application No. 12/542,908, filed on Aug. 18, 2009, now Pat. No. 8,406,963.

(51) Int. Cl.

| | |
|---|---|
| ***G05D 1/02*** | (2006.01) |
| ***G05D 1/08*** | (2006.01) |
| ***G06F 7/64*** | (2006.01) |
| ***G06F 17/00*** | (2006.01) |

(52) U.S. Cl.
USPC ..... 701/50; 172/2; 172/10; 37/348; 37/415

(58) Field of Classification Search
USPC ..... 701/36, 37, 38, 49, 50, 70; 172/2, 4, 5, 172/7, 10; 37/348, 413, 414, 415
See application file for complete search history.

(56) References Cited

U.S. PATENT DOCUMENTS

| | | | |
|---|---|---|---|
| 3,497,014 | A | 2/1970 | Ask |
| 3,556,225 | A | 1/1971 | Matsuzaki |
| 3,831,683 | A | 8/1974 | Ikeda et al. |
| 3,896,899 | A | 7/1975 | Scholl |
| 4,157,118 | A | 6/1979 | Suganami et al. |
| 4,181,999 | A | 1/1980 | Maust et al. |
| 4,273,196 | A | 6/1981 | Etsusaki et al. |
| 4,431,060 | A | 2/1984 | Scholl et al. |
| 4,630,685 | A | 12/1986 | Huck, Jr. et al. |
| 4,807,131 | A | 2/1989 | Clegg |
| 4,923,015 | A | 5/1990 | Barsby et al. |
| 5,174,385 | A | 12/1992 | Shinbo et al. |
| 5,398,766 | A | 3/1995 | Nakayama et al. |

(Continued)

FOREIGN PATENT DOCUMENTS

| | | | |
|---|---|---|---|
| EP | 1 118 713 | A1 | 7/2001 |
| JP | 06057782 | A | 3/1994 |
| WO | WO 2011/107096 | A1 | 9/2011 |

*Primary Examiner* — Thomas Tarcza
*Assistant Examiner* — Edward Pipala
(74) *Attorney, Agent, or Firm* — Finnegan, Henderson, Farabow, Garrett & Dunner LLP

(57) ABSTRACT

This disclosure relates to a control system for a machine implement. The control system includes a measurement sensor configured to provide an implement measurement signal indicative of a velocity of a machine implement, and a controller. The controller is configured to provide an implement measurement signal and an operator command signal, and to determine an adjusted implement command based signal based on the implement measurement signal and the operator command signal.

21 Claims, 6 Drawing Sheets

(56) References Cited

U.S. PATENT DOCUMENTS

| | | | |
|---|---|---|---|
| 5,424,623 | A | 6/1995 | Allen et al. |
| 5,467,829 | A | 11/1995 | Barton et al. |
| 5,487,428 | A | 1/1996 | Yamamoto et al. |
| 5,493,798 | A | 2/1996 | Rocke et al. |
| 6,181,999 | B1 | 1/2001 | Yamamoto et al. |
| 6,286,606 | B1 | 9/2001 | Krieg et al. |
| 6,757,994 | B1 | 7/2004 | Hendron |
| 6,763,619 | B2 | 7/2004 | Hendron et al. |
| 7,121,355 | B2 | 10/2006 | Lumpkins et al. |
| 7,317,977 | B2 | 1/2008 | Matrosov |
| 2002/0162668 | A1 | 11/2002 | Carlson |
| 2008/0313935 | A1 | 12/2008 | Trifunovic |

FIG. 6

| | CASE #1 | | CASE #2 | | CASE #3 | | CASE #4 | |
|---|---|---|---|---|---|---|---|---|
| | ROTATION RATE (DEG/S) | ROTATION DIRECTION | ROTATION RATE (DEG/S) | ROTATION DIRECTION | ROTATION RATE (DEG/S) | ROTATION DIRECTION | ROTATION RATE (DEG/S) | ROTATION DIRECTION |
| MACHINE DISTURBANCE | -8 | DOWNWARD | -8 | DOWNWARD | -8 | DOWNWARD | -8 | DOWNWARD |
| OPERATOR LIFT COMMAND | 0 | DOWNWARD | 5 | UPWARD | 20 | UPWARD | -5 | DOWNWARD |
| RESULTANT ERROR (NO CONTROL SYSTEM) | -8 | DOWNWARD | -3 | DOWNWARD | 12 | UPWARD | -13 | DOWNWARD |
| APPROXIMATE SYSTEM CORRECTION | 4.8 | UPWARD | 1.8 | UPWARD | -7.2 | DOWNWARD | 7.8 | UPWARD |
| TOTAL LIFT COMMAND | 4.8 | UPWARD | 6.8 | UPWARD | 12.8 | UPWARD | 2.8 | UPWARD |
| RESULTANT ERROR (WITH CONTROL) | -3.2 | DOWNWARD | -1.2 | DOWNWARD | -4.8 | DOWNWARD | -5.2 | DOWNWARD |

IMPLEMENT CONTROL SYSTEM FOR A MACHINE

This is a continuation of U.S. Pat. application No. 12/542,908, filed Aug. 18, 2009 and entitled "IMPLEMENT CONTROL SYSTEM FOR A MACHINE" (pending), the entire disclosure of which is incorporated herein by reference.

TECHNICAL FIELD

This disclosure relates generally to a system and method for controlling an implement on a machine. More specifically, the system includes a machine implement, a measurement sensor configured to provide an implement measurement signal indicative of a velocity of a machine implement, and a controller configured to receive the implement measurement signal, receive an operator command signal, and determine an adjusted operator command signal based on the implement measurement signal and the operator command signal.

BACKGROUND

Machines such as a tractors or bulldozers are equipped with attached implements for performing various tasks. For example, a tractor may be equipped with a blade for scraping the ground and pushing material. An operator can move the position of the blade up and down relative to the ground. This helps the tractor complete the task of properly leveling or contouring the ground on which the tractor is operating. This is a task often performed during the construction of roads, buildings, or other structures.

One difficulty facing a tractor is that the movement of the tractor over uneven terrain results in the blade pitching up or down as the tractor itself pitches up or down across the terrain. For example, if the tractor begins to climb over a bump, the front of the tractor will pitch up, resulting the tractor's blade also pitching up. The causes the blade to dig shallower than if the tractor were on level ground.

Conversely, if the front of the tractor pitches downward, the blade will also pitch downward. Unless the operator corrects for this movement, the pitching of the blade will result in the blade digging into the earth too deeply than is desired.

Operators of a tractor can correct for uneven terrain by adjusting the motion. of the blade as the machine moves over uneven terrain. For example, if the operator perceives that the tractor is pitching or will pitch upward, the operator can command the blade to move downward to compensate for the tractor's movement, resulting in a smoother surface. However, the quality of the resulting grade is dependent on the skill of the operator in anticipating the need to adjust the blade. The operator may have to slow the speed of the machine in order to better adjust the blade in response to uneven terrain, which reduces the efficiency of the machine and may increase the cost of completing the work.

Systems and methods exist to automatically adjust the position of an implement, such as a blade on a tractor, to produce more uniform results. For example, systems may produce a map of the worksite with target finishes, which can be fed to sensors on the machine to automatically adjust the blade to produce a desired finish. These systems may produce desirable results, but may be very expensive. Also, the finished surface must often be defined accurately before work can begin, rather than allowing for adjustment that can be achieved as work at the site progresses. It is desirable to have a system that still produces a smoother finish than obtainable by operator adjustment alone, but does not require as much expensive equipment and control systems as in many prior art grading systems. The system should provide greater efficiency than. no control on the machine, U.S. Pat. No. 7,121,355 to Lumpkins et. al ("Lumpkins") discloses a system for controlling the position of a machine blade for grading. Lumpkins, control system determines the difference between a target position of a blade and an actual position, and generates a control signal calculated to move the blade to the target position.

Although the system disclosed by Lumpkins purports to more accurately control the position of a blade, the Lumpkins system may not adequately compensate for the fact that the operator may be commanding the machine implement in anticipation of uneven terrain. The system disclosed by Lumpkins does not electronically attempt to discern a difference between when an operator is attempting to move the blade to a new target position, and when the operator is merely attempting to compensate for uneven terrain. Consequently, the Lumpkins system requires a separate lever that the operator controls, which alternately tells the system to return the blade to a target position, or tells the system that the operator is attempting to override the control system and move the blade to a new target position.

It is desirable to have a control system which is easier to operate, and which adjusts the implement rate of change on a machine in response to uneven terrain while recognizing that the operator may simultaneously be issuing implement commands which attempt to achieve the same intention as the control system. Moreover, it is desirable to have a machine implement control system that produces a smoother grade or contour without the necessity of knowing or calculating an actual target position for the implement.

The present disclosure is directed to overcoming or mitigating one or more of the problems set forth above.

SUMMARY

In one aspect, a control system for a machine is disclosed. The control system includes a sensor configured to provide an implement measurement signal indicative of a velocity of a machine implement, and a controller configured to receive the implement measurement signal, receive an operator command signal, and determine an adjusted operator command signal based on the implement measurement signal and the operator command signal.

In another aspect, a method for adjusting a machine implement is disclosed. The method includes the steps of providing an implement measurement signal indicative of a velocity of the machine implement, and providing an operator command signal indicative of an operator-desired movement of the machine implement. The method also includes the steps of determining an adjusted operator command signal based on the implement measurement signal and the operator command signal, and commanding a change in the velocity of the machine implement based on the adjusted operator command signal.

In another aspect, an earth-moving machine includes a ground-engaging blade, and a measurement sensor mounted on the ground-engaging blade and configured to provide an implement measurement signal indicative of a velocity of the ground-engaging blade. The earth-moving machine also includes a controller configured to receive the implement measurement signal, receive an operator command signal indicative of an operator-desired movement of the ground-engaging blade, and determine an adjusted operator command signal based on the implement measurement signal and the operator command signal.

BRIEF DESCRIPTION OF THE DRAWINGS

FIG. 6 shows a table of example performance of a system in accordance with the disclosure.

DETAILED DESCRIPTION

Figure 1:
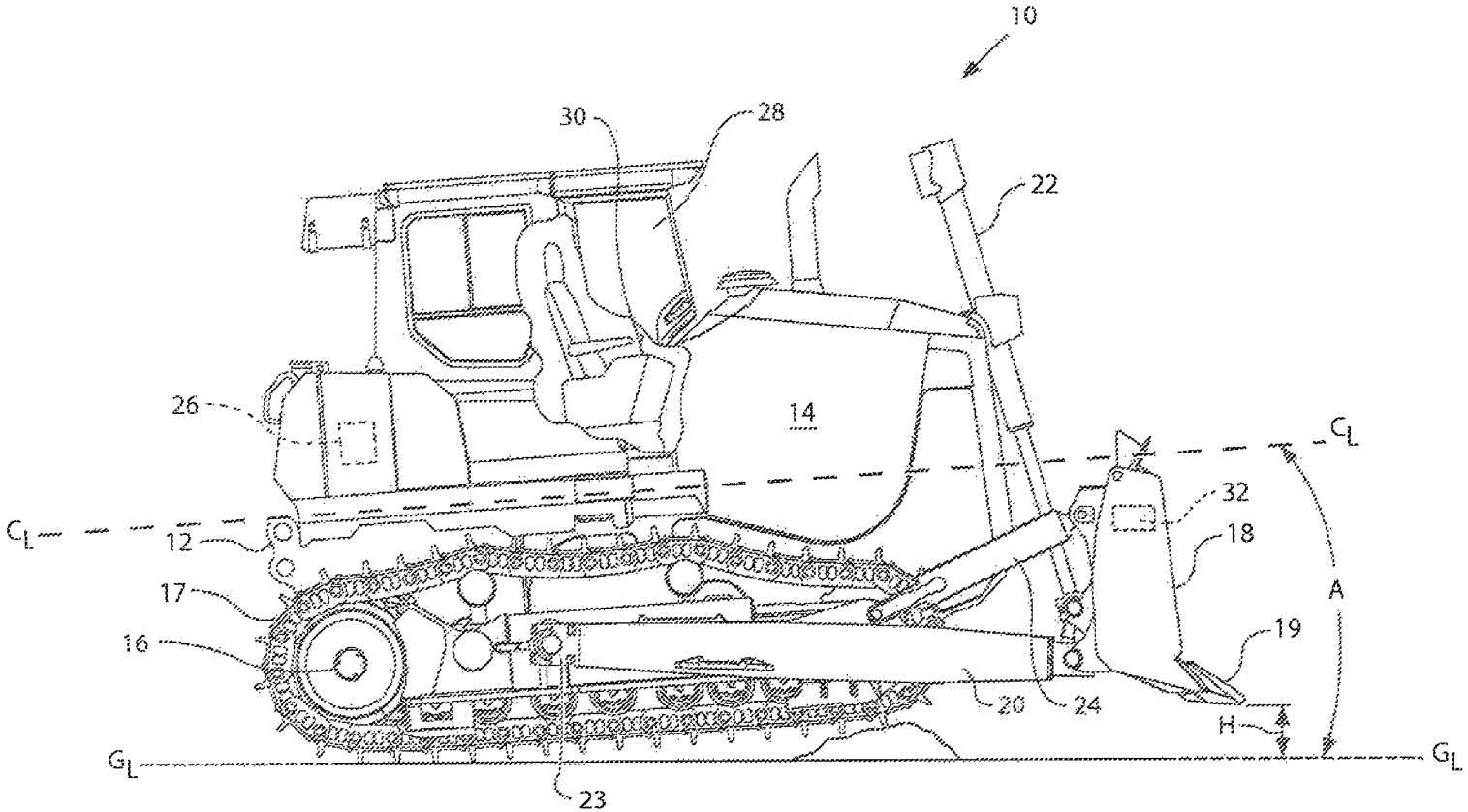
FIG. 1 shows a diagrammatic illustration of a machine in accordance with the disclosure.

FIG. 1 shows a diagrammatic illustration of a machine in accordance with an embodiment of the disclosure. A tractor 10 includes a frame 12 and an engine 14. A drive wheel 16 drives a track 17 to propel tractor 10. Although tractor 10 is shown in a "track-type" configuration, other configurations, such as a wheeled configured, may be used. In addition, the systems and methods of the disclosure may be used with any convenient machine propulsion and drive train mechanisms applicable in the art. This is notable as there are an increasing number of machine propulsion and drive train systems available in the art. Further, the systems and methods disclosed herein may also be used on machines other than a tractor having a ground-engaging blade, such as a loader or grader.

Tractor 10 includes a blade 18 pivotally connected to frame 12 by arms 20 only one side shown) on each side of tractor 10. Hydraulic cylinders 22 coupled to frame 12 support blade 18 in the vertical direction, and allow blade 18 to pitch up or down vertically from the point of view of FIG. 1. Hydraulic cylinders 24 on each side of tractor 10 allow the angle of blade tip 19 to change relative to a centerline of the machine ("CL" in FIG. 1).

Hydraulic cylinders 22, 24 are preferably electro-hydraulically controlled, receiving signals from a control module 26. Control module 26 generates a signal that is translated into a direction and magnitude of movement of the appropriate hydraulic cylinders 22, 24. As shown in FIG. 1, movement of hydraulic cylinders 22, 24 results in rotation of blade 18. Thus the direction and amount of movement of blade 18 relates to one or more signals generated by control module 26.

Control module 26 may be mounted at any convenient location on tractor 10. Tractor 10 may include more than one control module 26 to control various different functions and systems of tractor 10.

Control module 26 may include one or more of the following: a microprocessor, memory (e.g., RAM, ROM), data storage devices (e.g., optical media, memory, hard drives), sensor input circuits, system control circuits, and executable software. These components perform the functions of the control system disclosed herein and/or perform tasks related to other systems on tractor 10. One skilled in the art may choose a suitable combination of hardware and/or software components as appropriate for the machine.

Tractor 10 includes cab 28 from which an operator may control tractor 10. Cab 28 includes one or more controls from which the operator issues commands. FIG. 1 shows a joystick 30 from which an operator may control one or more machine implements, such as blade 18. Joystick 30 may be configured to automatically return to a "neutral" position if the operator is not moving joystick 30 in a particular direction. The operator can move joystick 30 up to command rotation of blade 18 vertically from the ground, or move joystick 30 to command rotation of blade 18 vertically toward the ground.

Joystick 30 may also be configured to control other aspects of blade 18, such as blade angle rate of change (e.g., actuating hydraulic cylinders 24). Preferably, joystick 30 operates as part of an electro-hydraulic control system on tractor 10 wherein the operator's movement of joystick 30 (including the magnitude of the movement of joystick 30) are translated into a signal and sent to control module 26. Thus, movement of joystick 30 generates a signal to control module 26 indicative of the magnitude and direction of the operator's movement of joystick 30. Control module 26 may process this signal and potentially adjust the signal prior to issuing a signal to hydraulic cylinders 22, 24 to adjust blade 18. This is further described below.

Tractor 10 is equipped with measurement sensor 32. Measurement sensor 32 is preferably mounted on blade 18, but may be mounted on arms 20 or frame 12. Measurement sensor 32 provides data that is indicative (directly or indirectly) of velocity of an implement such as blade 18. Measurement sensor 32 may be a pitch rate sensor (e.g., gyroscope), to measure the rate of change of the blade 18 as it rotates about an axis defined by a pivot connection 23 of blade 18 to frame 12 (e.g., the pivot connection of arms 20 to frame 12). The height of blade 18 relative to the machine centerline (shown in FIG. 1 as "CL") is proportional to the angular rotation of blade 18 about pivot connection 23. Thus, when an operator issues a command that raises or lowers blade 18 (for example, by actuating hydraulic cylinders 22), measurement sensor 32 may register an angular rotation signal proportional to the amount of movement of blade 18.

Similarly, when tractor 10 pitches upwards or downwards, such as when traversing uneven terrain, blade 18 also pitches upwards or downwards. Thus, measurement sensor 32 may register an angular rotation signal proportional to the amount of movement (rotation around the mounting axis) of blade 18.

Alternatively, measurement sensor 32 may be an accelerometer. In this configuration, the accelerometer is preferably mounted to blade 18 or arms 20. In this embodiment, the accelerometer may provide a signal indicative of the acceleration and/or velocity of blade 18.

Tractor 10 may be equipped with a user switch (not shown) to activate or de-activate the electronic control system that uses measurement sensor 32. If the control system is de-activated, then tractor 10 will ignore the signal generated by measurement sensor 32. In this case, blade 18 will move according to the operator's commands and will not be otherwise adjusted for pitching of tractor 10.

Figure 2:
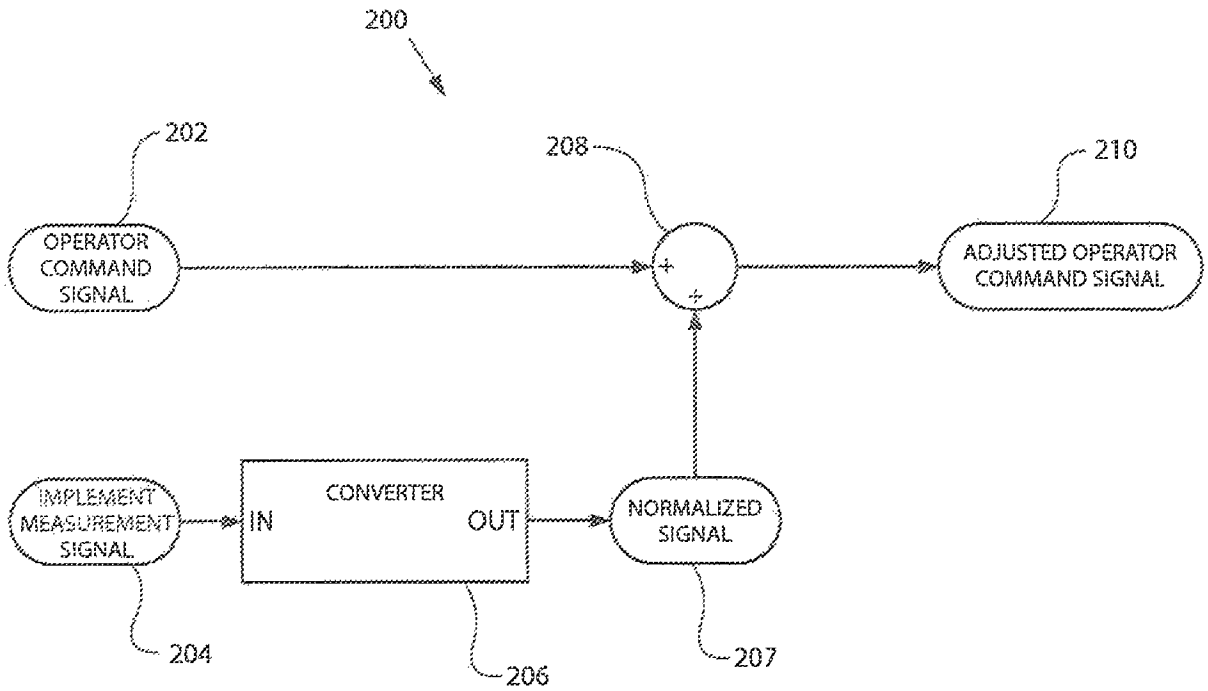
FIG. 2 shows an exemplary schematic diagram of a system to produce an adjusted operator command signal.

If the control system is activated, FIG. 2 shows a diagram of a control system 200 according to an embodiment of the disclosure. Signal 202 is an "operator command signal," used herein to denote a signal indicative of the operator's commanded movement of the implement (if any). For example, referring to FIG. 1, if an operator issues a command to raise blade 18, then signal 202 represents the signal generated from movement of joystick 30. This signal may indicate both a direction (i.e., that the operator wishes to lift the blade or lower the blade) and a magnitude of rate of change. Signal 202 is preferably a normalized command that represents a percent of the total possible displacement range of joystick 30.

Signal 204 is an "implement measurement signal," used herein to denote a signal representing an amount of blade 18 rotation command required to counteract the motion of blade 18 as registered by measurement sensor 32. For example, if tractor 10 is pitching up, measurement sensor 32 may measure that blade 18 is moving upwards.

Control module 26 will calculate the signal required to send to hydraulic cylinders 22, 24 to counteract the movement of blade 18, which is represented by signal 204. Signal 204 may be converted to a "normalized" signal at converter 206 to produce signal 207. In other words, if signal 206 represents an implement velocity command in degrees per second, this signal may be converted to represent an equivalent percent command of the operatory joystick. Signal 207 thus represents the controller-calculated represented in terms 318 of a hypothetical operator joystick movement that would need to be issued to counteract the movement of blade 18.

Control module 26 compares signal 202 and signal 207 and produces an adjusted operator command signal 210 based at least in part on signal 202 and/or signal 207. The process of combining signal 202 and signal 207 is represented by combination circuit 208. The methodology of comparing and combining signal 202 and signal 207 to produce adjusted operator command signal 210 is described in detail below, specifically with respect to FIG. 5. Adjusted operator command signal 210 represents a signal sent to one or more hydraulic cylinders, the result of which may raise or lower blade 18 and may wholly or partially mitigate the movement of blade 18 relative to the ground.

It should be noted that the combination method shown in FIG. 2 is not the only way to combine an implement measurement signal with an operator command signal. For example, the implement measurement signal need not be converted into an equivalent hypothetical operator command prior to being compared to the operator command signal.

Figures 3A, 3B, 3C, 3D:
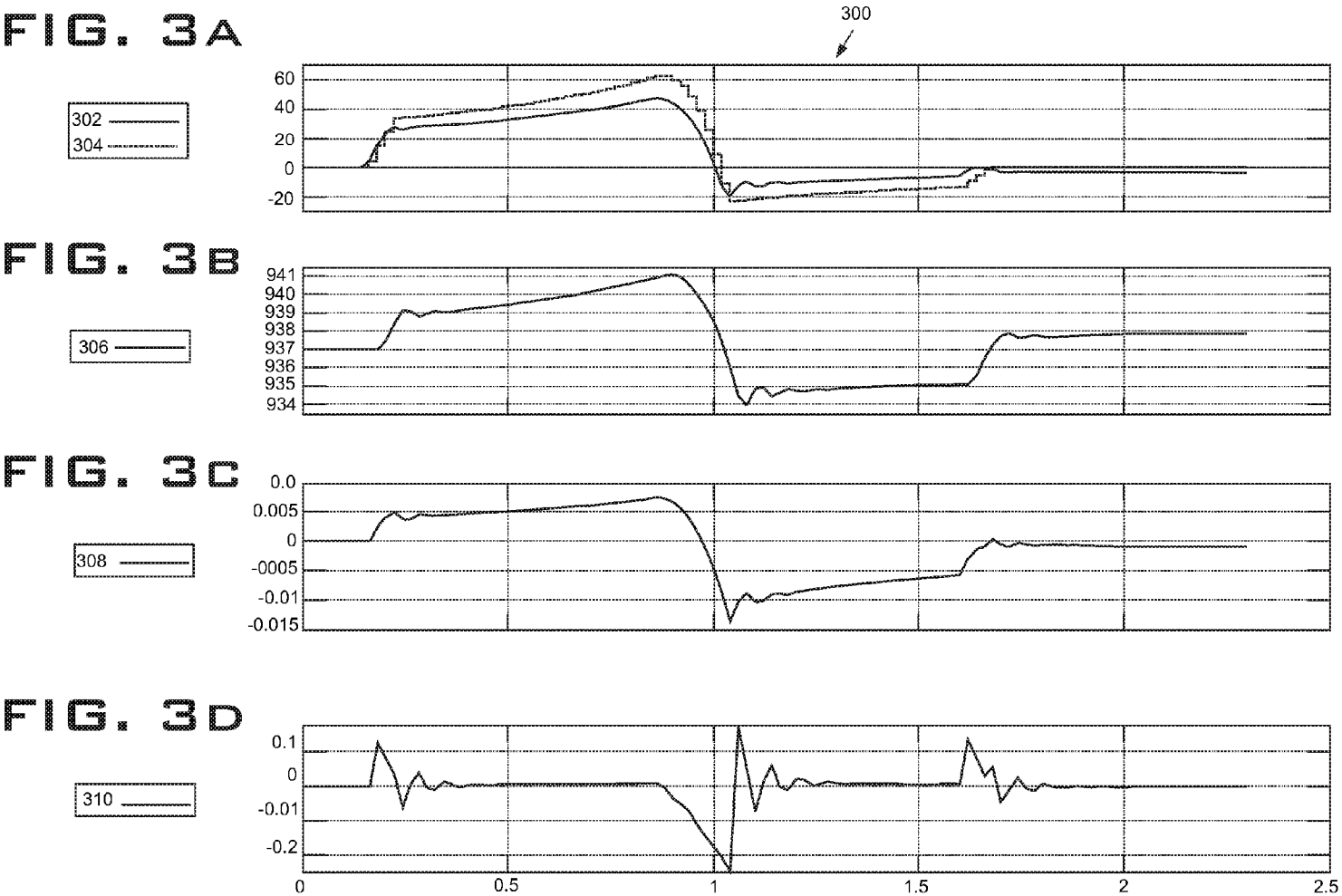
FIGS. 3A-3D show exemplary performance graphs of a system in accordance with an embodiment of the disclosure.

FIG. 3 shows exemplary performance graphs of a system 300 in accordance with the disclosure. FIG. 3*a* shows a graph of blade tip height (relative to the centerline of a test machine) versus time, as the machine moves over a roughly triangular shaped bump (e.g., similar to that shown in FIG. 1). Line 304 shows blade tip height as the machine moves over the bump without employing an implement control system. Line 302 shows blade tip height over time as a test machine moves over the same bump, but with the machine employing an implement control system described herein. As shown, the overall magnitude of change of the blade tip height is less when the machine employs an implement control system as described herein, and the system may return to a steady-state condition within a smaller time interval than in the absence of a control system.

FIG. 3*b* shows the extension length (in mm) of a hydraulic cylinder controlling blade height versus time. The graph of FIG. 3*b* is for the same test as the test shown by line 302 in FIG. 3*a*. FIG. 3*c* shows the velocity of the same cylinder (in mm/sec) for the same test, and FIG. 3*d* shows the pitch (in radians) for the same test. As shown by FIG. 3*b*, the control system according to the present disclosure may not return the blade to the exact previous position prior to encountering uneven terrain, because the system does not have a target position. In FIG. 3*b*, the cylinder length settles mm away from its previously length before the uneven terrain. Likewise, in FIG. 3*a* line 302 does not exactly return to "0." There may be a small drift associated with the system. However, because the system decreases the overall magnitude of the movement of the blade as the machine traverses uneven terrain, the end result of employing the control system may be a smoother, more desirable finish.

Industrial Applicability

The present disclosure provides an advantageous systems and methods for controlling the implement on a machine, such as a blade on a tractor or a bucket on a loader. A machine implement can be controlled to produce a smoother implement motion while remaining intuitive to the operator and without employing more expensive control systems that require predefined data about conditions at the worksite.

Figure 4:
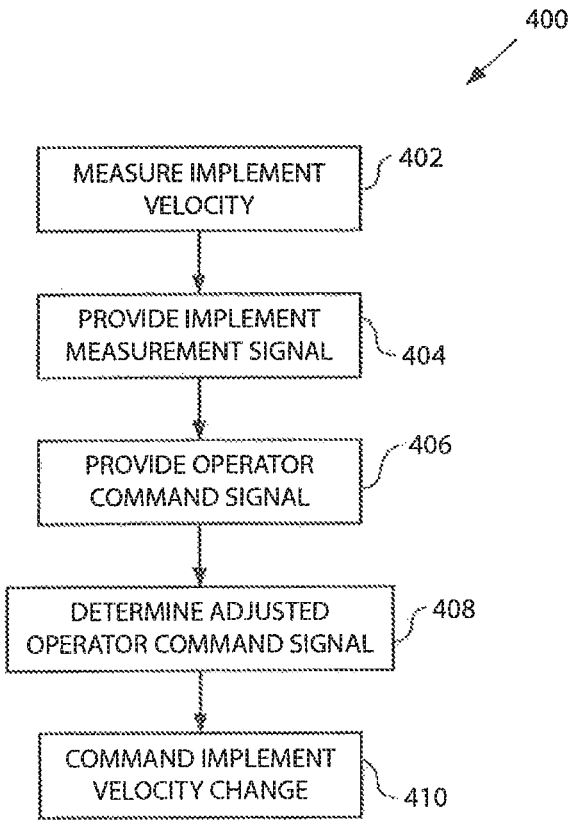
FIG. 4 shows a flowchart of a method in accordance with the disclosure.

FIG. 4 shows a flowchart of a method 400 according to an embodiment of the disclosure. FIG. 1 will be referenced as an example, however the method is not limited to the exact configuration shown in FIG. 1. In the first step, step 402, the velocity of the implement (e.g., blade 18) is measured by a measurement sensor (e.g., measurement sensor 32). The measurement sensor sends a signal to an electronic control module on board the machine, step 404. This signal may be indicative of a rate of change of position of the implement. The signal may require further processing by the electronic control module to indicate the implement's movement.

In step 406, the control module on board the machine provides an operator command signal. In some embodiments, an operator command signal may be generated even when the operator has not commanded any implement movement (i.e., the joystick is in the neutral position). This may be helpful to verify to the electronic control module that no operator command is presently issued.

In step 408, the implement measurement signal of step 404, and the operator command signal of step 406 are compared and potentially combined to determine a new signal, an "adjusted operator command signal," that directs the desired movement of the implement. In step 410, the machine implement velocity is adjusted, preferably whereby signal 408 actuates an electro-hydraulic control system to adjust the velocity of the machine implement. The implement velocity may be adjusted to counteract all velocity of the blade, or alternatively the implement velocity may be adjusted to meta substantially constant target rate of change of machine implement velocity, for applications such as grading. In reviewing method 400 in FIG. 4, the steps of method 400 need not be performed in the exact order as shown. For example, step 406 may be performed before step 404. Steps 404 and 406 may also be performed simultaneously.

Figure 5:
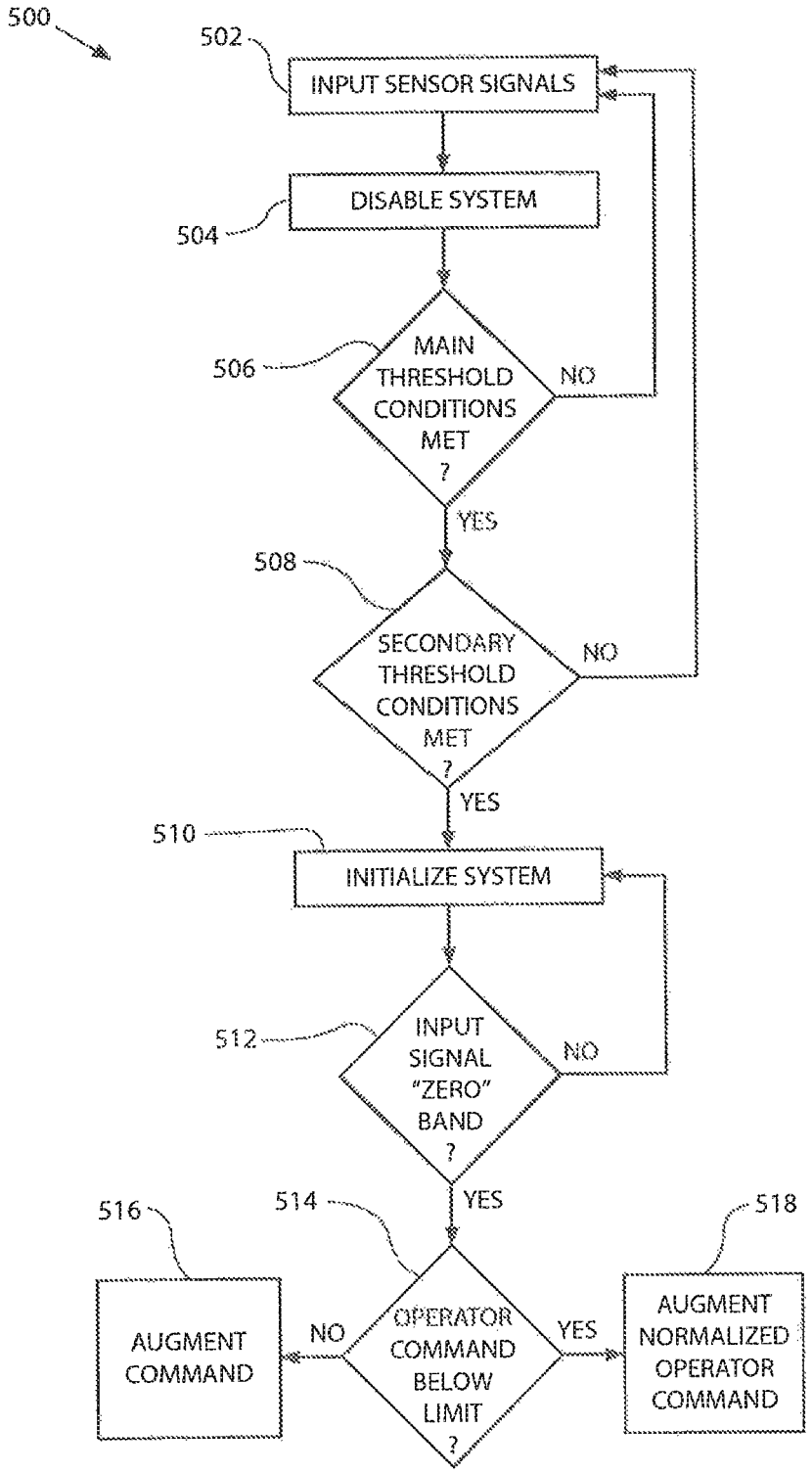
FIG. 5 shows a flowchart of a method in accordance with the disclosure.

FIG. 5 shows a flowchart of a method 500 for implement control in accordance with an embodiment of the disclosure. The steps herein describe a complete activation of the system, such as from when a machine is first powered on. One of skill in the art will recognize that some steps are optional depending upon the specific configuration of the machine and the needs of the specific operator.

In the first step, step 502, an implement measurement signal is input to a controller on the machine containing the control system. In step 504, the implement control system is disabled. This may be the default condition when the machine is powered on, until the controller determines that one or more threshold conditions are satisfied prior to activating the implement control system. In this situation, the controller might receive an implement measurement signal but ignore this signal until the threshold activation conditions are met.

In step 506, the controller determines whether main threshold conditions are met in order to activate the control system. For example, the machine may contain an operator switch to indicate whether the operator of the machine wishes to activate the implement control system. One threshold condition may thus be whether a switch is in an "on" position, or similar indication is given by the operator to turn on the control system. In addition, the machine might have an implement lock switch or other device designed to stop the implement from moving. A threshold condition prior to starting the control system may be that an implement lock is not in place.

Another main threshold condition may be that the machine transmission is in a certain state (e.g., not in neutral). Still another example threshold condition may be that the machine ground speed is above a threshold amount (for example, above zero), or that the engine RPM is within a certain range. Still another threshold condition may be that one or more other control systems are not active and controlling the implement. This type of condition is desirable if the machine is equipped with multiple different implement control systems that are mutually exclusive and that cannot operate together.

If the main threshold conditions are not met in step 506, the implement control system is not activated, and the machine system returned to an earlier step (e.g., step 502) until the main threshold conditions are met.

if the main threshold conditions are met in step 506, the controller may proceed to determine whether any secondary threshold conditions are met before activating the implement control system, step 508. For example, the controller may examine whether the machine ground speed is below a maximum allowable speed for the implement control system. The controller may also determine whether the machine steering is below a maximum turn rate, to turn off the implement control system during large turns. The controller may also check whether the implement is in a float configuration.

The controller may also check whether the operator is commanding a very large movement of the implement, above a threshold value. For example, if the operator is giving a command to raise the implement by a large magnitude (e.g., the operator is attempting to raise the implement over an obstacle), the controller may de-activate the implement control system (or prevent the control system from initially activating) and not attempt to mitigate the operator commanded implement movement. Thus, another secondary threshold condition may be that the operator's command to move the implement is below a threshold magnitude.

For steps 506 and 508, the controller may optionally also determine whether the main and/or secondary threshold conditions are met for a predetermined amount of time before activating the implement control system. For example, the controller may ensure that the machine speed is above a threshold speed for a predetermined amount of time (e.g., 80 milliseconds) before considering the threshold condition satisfied. The predetermined amount of time may apply to one, some, or all threshold conditions prior to activating the implement control system. In addition, the controller may have different predetermined time thresholds for different threshold conditions. For example, the controller may ensure that the machine speed is above a threshold speed for at least 80 milliseconds and that the machine steering is below a maximum threshold for 2 seconds prior to activating the implement control system.

If the main and secondary threshold conditions are met, then the implement control system is initialized, step 510. The system begins to interpret the implement measurement signal. This may include employing a low pass filter to eliminate sensor noise, and/or a high pass filter to reduce any steady-state offsets due to temperature variation, unbalanced noise, and/or other common causes of signal deviation known to those of skill in the art.

In the next step, step 512, the controller checks to see if the sensor input signal falls in between a "zero" band for a specified amount of time. Essentially this tests whether the magnitude of the motion of the blade, as measured by the measurement sensor, is so small as to be considered zero by the controller. The controller may set a magnitude below which the motion of the implement is to be considered zero, and no automatic implement control signal is generated to counteract this minimal sensed motion of the implement. This strategy may help prevent undesirable "drift" of the implement when the measurement sensor registers a very small but mathematically non-zero implement motion. If the input signal is within the zero band, then the controller may re-attempt step 510 (and/or steps 506 and 508).

If the implement measurement signal is not in the "zero" band (i.e., is of a sufficiently large magnitude), the controller may compare the implement measurement signal to the magnitude and direction of the operator command signal (if any).

During the comparison, a number of different scenarios may result, as shown in FIG. 6. One possible scenario, Case #1 in FIG. 6, is that as the machine pitches over a bump, the operator gives no implement command at an For example, if the machine implement (e.g., a ground-engaging blade) is pitching downward at a rate of 8 degrees per second as the machine traverses uneven terrain, the operator might give no implement command. In this case, the resultant error (the difference between the actual blade movement and the blade movement required to maintain a constant level) would be 8 degrees per second, without any control system to correct the blade's movement. However, if the control system were employed, the measurement sensor would measure that the blade is moving downward at a rate of 8 degrees per second, and calculate a correction to the blade velocity. In FIG. 6, the control system calculates an adjusted operator command signal to raise the blade upward at a rate of 4.8 degrees per second, which results in an error of 3.2 degrees per second. It may be desirable in some circumstances to correct only part of the measured error, to keep the overall blade movements smoother. However, alternatively the control system can be configured to issue an adjusted operator command signal that attempts to fully compensate for the measured error. Either way, employment of the control system in Case #1 in FIG. 6 reduces the overall error of blade movement.

Another possible scenario, shown as Case #2 in FIG. 6, is that as the machine traverses uneven terrain, the operator attempts to adjust the blade motion to counteract the impact of the uneven terrain on the blade movement. However, operator does not command enough of a correction to fully counteract the blade movement. In this example, the operator issues a command sufficient to move the blade 5 degrees per second upward. As a result, the net movement of the blade is still 3 degrees per second downward (which is the amount detected by the measurement sensor if the measurement sensors is mounted on the blade). Consequently, the control system issues an implement control command of 6.8 degrees upward, which represents the operator's command of 5 degrees upward plus the control system's augmentation of 1.8 degrees upward. In a sense, the controller "corrects" the operator's command by augmenting the command in order to produce a smoother blade motion.

Case #3 in FIG. 6 represents another possible scenario as the machine traverses uneven terrain. The operator may sense the uneven terrain, and correct the blade in the proper direction, but issue a command that is larger than necessary to compensate for the uneven terrain (e.g., "overcorrect"). For example, if the uneven terrain results in a disturbance sufficient to move the implement 8 degrees per second downwards, the operator may issue a command to raise the blade at a rate of 20 degrees per second upwards. Without a control system, the combination of these two forces would result in a net upward movement of the blade at a rate of 12 degrees per second relative to the ground. However, employing the control system, the measurement sensor on the implement would measure the 12 degree per second net movement, and correct at least part of this movement. In the example shown, the control system corrects by reducing the total lift command provided to the implement, which reduces the overall error.

Another potential scenario is shown in Case #4 in FIG. 6. As the machine traverses uneven terrain, the blade may move while the operator issues a command that might exacerbate the blade's uneven movement. In this case, the control system. "fights" the operator by issuing a command in the opposite direction, in an effort to slow the movement of the blade relative to the ground.

One of skill in the art can appreciate that the numbers listed in FIG. 6 are exemplary data only, used to further describe the action of a control system as described herein, and that actual scope of control system is not limited to these exemplary numbers used for teaching purposes.

Returning to FIG. 5, embodiments of the present disclosure herein need not exactly follow the steps shown in FIG. 5. For example, steps 506 and 508 may be combined into a single step, and may have further options or conditions as needed for various machine and implement configurations. In addition, the controller may be configured to re-check the threshold conditions at regular or random time intervals while the implement control system is active, to determine whether the implement control system should be de-activated.

Other embodiments, features, aspects, and principles of the disclosed examples will be apparent to those skilled in the art and may be implemented in various environments and systems.

What is claimed is:

1. A control system for a machine, comprising:

a sensor configured to provide an implement measurement signal indicative of a velocity of a machine implement; and a controller configured to:

receive the implement measurement signal, receive an operator command signal, and determine an adjusted operator command signal based on the implement measurement signal and the operator command signal.

2. The system of claim 1, wherein the controller is further configured to set a substantially constant target rate of change of machine implement velocity.

3. The system of claim 1, wherein the sensor is one of: an accelerometer, a gyroscope.

4. The system of claim 3, wherein the sensor is mounted on the machine implement.

5. The system of claim 4, wherein the machine implement is a ground-engaging blade of an earth-moving machine.

6. The system of claim 3, wherein the implement measurement signal measures an angular velocity of the machine implement about an attachment point of the machine implement to the machine.

7. The system of claim 1, wherein the adjusted operator command signal moves the machine implement in the same direction as the direction of the operator command signal.

8. The system of claim 1, wherein the adjusted operator command signal moves the machine implement when the operator has not commanded movement of the machine implement.

9. The system of claim 1, wherein the adjusted operator command signal moves the machine implement in the opposite direction as the direction of the operator command signal.

10. A method for adjusting a machine implement, comprising:

providing an implement measurement signal indicative of a velocity of the machine implement;

providing an operator command signal indicative of an operator-desired movement of the machine implement, determining, at a controller, an adjusted operator command signal based on the implement measurement signal and the operator command signal, and commanding a change in the velocity of the machine implement based on the adjusted operator command signal.

11. The method of claim 10, wherein the step of providing an implement measurement signal includes measuring the acceleration of the machine implement.

12. The method of claim 11, including the step of setting a substantially constant target rate of change of machine implement velocity.

13. The method of claim 10, including the step of actuating a hydraulic cylinder to change the rotation rate of the machine implement.

14. The method of claim 10, wherein the step of determining an adjusted operator command signal includes reducing the operator-commanded change of velocity of the machine implement.

15. The method of claim 10, wherein the step of determining an adjusted operator command signal includes increasing the operator-commanded change of velocity of the machine implement.

16. The method of claim 10, wherein the step of determining an adjusted operator command signal includes setting the compensated operator command signal to the operator command signal if the operator command signal is above a threshold magnitude.

17. The method of claim 10, wherein the step determining an adjusted operator command signal includes setting the compensated operator command signal to zero if the implement measurement signal is below a threshold magnitude.

18. An earth-moving machine comprising:

a ground-engaging blade;

a measurement sensor mounted on the ground-engaging blade and configured to provide an implement measurement signal indicative of a velocity of the ground-engaging blade; and a controller configured to:

receive the implement measurement signal, receive an operator command signal indicative of an operator-desired movement of the ground-engaging blade, and determine an adjusted operator command signal based on the implement measurement signal and the operator command signal.

19. A control system for a machine, comprising:

a sensor configured to provide an implement measurement signal indicative of a velocity of a machine implement resulting from pitching of the machine; and a controller configured to:

receive the implement measurement signal, receive an operator command signal, and determine an adjusted operator command signal based on the implement measurement signal and the operator command signal, the adjusted operator command signal partially compensating for a deficiency in the operator command signal.

20. A method for adjusting a machine implement, comprising:

providing an implement measurement signal indicative of a velocity of the machine implement resulting from pitching of the machine;

providing an operator command signal indicative of an operator-desired movement of the machine implement to counteract movement resulting from said pitching of the machine;

determining at a controller an adjusted operator command signal, based on the implement measurement signal and the operator command signal, which only partially compensates for a deficiency in the operator command signal; and commanding a change in the velocity of the machine implement based on the adjusted operator command signal.

21. An earth-moving machine comprising:

a ground-engaging blade;

a measurement sensor mounted on the ground-engaging blade and configured to provide an implement measurement signal indicative of a velocity of the ground-engaging blade resulting from movement of the ground-engaging blade which is caused by unintended pitching of the machine; and a controller configured to:

receive the implement measurement signal, receive an operator command signal indicative of an operator-desired movement of the ground-engaging blade, the operator command signal counteracting said movement of the ground-engaging blade, and determine an adjusted operator command signal based on the implement measurement signal and the operator command signal, the adjusted operator command signal partially compensating for a deficiency in the operator command signal to fully counteract said movement of the ground-engaging blade.

* * * * *

UNITED STATES PATENT AND TRADEMARK OFFICE

CERTIFICATE OF CORRECTION

PATENT NO. : 8,762,010 B2
APPLICATION NO. : 13/839253
DATED : June 24, 2014
INVENTOR(S) : Farmer et al.

It is certified that error appears in the above-identified patent and that said Letters Patent is hereby corrected as shown below:

In the Specification

Column 1, line 6, delete "(pending)," and insert -- now U.S. Pat. No. 8,406,963, --.

Column 1, line 44, delete "motion." and insert -- motion --.

Column 2, line 2, delete "than, no control on the machine," and insert -- than no control on the machine. --.

Column 5, line 9, delete "controller-calculated represented in terms 318 of" and insert -- controller-calculated signal, represented in terms of --.

Column 5, line 54, delete "mm" and insert -- 1mm --.

Column 5, line 62, delete "Industrial Applicability" and insert -- INDUSTRIAL APPLICABILITY --.

Column 6, line 30, delete "meta" and insert -- set a --.

Column 7, line 11, delete "if" and insert -- If --.

Column 7, line 29, delete "operator commanded" and insert -- operator-commanded --.

Column 8, line 11, delete "an" and insert -- all. --.

Column 9, lines 4-5, delete "system." and insert -- system --.

In the Claims

Column 11, line 1, in Claim 20, delete "determining at a controller an adjusted" and insert -- determining, at a controller, an adjusted --.

Signed and Sealed this
Eighth Day of September, 2015

Michelle K. Lee

Michelle K. Lee
*Director of the United States Patent and Trademark Office*